US008843045B2

(12) United States Patent
Ishikawa et al.

(10) Patent No.: US 8,843,045 B2
(45) Date of Patent: Sep. 23, 2014

(54) FUSER AND IMAGE-FORMING APPARATUS THAT USE ENDLESS BELT

(75) Inventors: Hiroyuki Ishikawa, Shizuoka-ken (JP); Satoshi Kinouchi, Tokyo (JP); Ryota Saeki, Shizuoka-ken (JP); Kazutoshi Takahashi, Shizuoka-ken (JP); Shoko Shimmura, Kanagawa-ken (JP); Toshihiro Sone, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 50 days.

(21) Appl. No.: 13/592,289

(22) Filed: Aug. 22, 2012

(65) Prior Publication Data

US 2013/0051878 A1 Feb. 28, 2013

Related U.S. Application Data

(60) Provisional application No. 61/528,056, filed on Aug. 26, 2011.

(30) Foreign Application Priority Data

Jun. 13, 2012 (JP) ..... 2012-133417

(51) Int. Cl.
*G03G 15/20* (2006.01)

(52) U.S. Cl.
CPC .... *G03G 15/2053* (2013.01); *G03G 2215/2038* (2013.01)
USPC ..... 399/329; 399/328

(58) Field of Classification Search
CPC ..... G03G 15/20; G03G 15/2025; G03G 15/2032; G03G 15/2035; G03G 15/2038; G03G 15/2064
See application file for complete search history.

(56) References Cited

U.S. PATENT DOCUMENTS

| | | | | |
|---|---|---|---|---|
| 2003/0103788 | A1 * | 6/2003 | Yura et al. | 399/329 |
| 2006/0083562 | A1 * | 4/2006 | Matsumoto et al. | 399/329 |
| 2011/0217096 | A1 | 9/2011 | Kikuchi et al. | |

FOREIGN PATENT DOCUMENTS

| | | | |
|---|---|---|---|
| JP | 2010-160528 | A | 7/2010 |

* cited by examiner

*Primary Examiner* — Clayton E Laballe
*Assistant Examiner* — Jas Sanghera
(74) *Attorney, Agent, or Firm* — Patterson & Sheridan LLP

(57) ABSTRACT

A fuser is equipped with a heating roller, fixing belt, pressure roller, pad, and spring. The heating roller is located on the downstream side of the fixing belt with respect to the sheet conveyance direction, and as the heating roller rotates, contacts the sheet toner side of a sheet, heating the sheet. The fixing belt contacts the side of the sheet opposite to the toner side of the sheet. The pressure roller comes into contact with the heating roller via the fixing belt. The pad is of a softer material than the fixing belt, and, as the pad exerts a force on the heating roller by pressing on the fixing belt, a downstream side of the pad with respect to the sheet conveyance direction is inclined away from the pressure roller. Springs urge the pad toward the pressure roller and the heating roller.

20 Claims, 4 Drawing Sheets

FUSER AND IMAGE-FORMING APPARATUS THAT USE ENDLESS BELT

CROSS-REFERENCE TO RELATED APPLICATION

This application is based upon and claims the benefit of priority from U.S. Patent Application No. 61/528,056, filed on Aug. 26, 2011, the entire contents of which are incorporated herein by reference.

This application is also based upon and claims the benefit of priority from Japanese Patent Application No. 2012-133417, filed on Jun. 13, 2012, the entire contents of which are incorporated herein by reference.

FIELD

Embodiments described herein relate to a fuser and an image-forming apparatus.

BACKGROUND

Conventionally, fusers used in image-forming apparatus have a heating roller and a belt looped around a section of the heating roller. Heating rollers are also referred to as fixing rollers. Generally, such a belt has multiple rollers arranged inside the loop formed by the belt. In addition to these rollers, one or more pads are disposed on the region facing the heating roller and come into contact with the belt. These pads are of a softer material than the belt material and are in a configuration that inclines away from the direction of sheet conveyance. In addition, such pads are pressed perpendicularly against the belt.

Nevertheless, after a long period of use, the pads wear down, and the distance between the downstream edge of the pad and the heating roller widens. As the gap between the pads and rollers widens, sheets may flutter and cause image distortion.

DETAILED DESCRIPTION

In one embodiment, the fuser of the present disclosure is equipped with a heating roller, fixing belt, pressure roller, pad, and spring. The heating roller is positioned on the downstream side of the fixing belt, with respect to the sheet conveyance direction, and as the heating roller rotates and comes into contact with the toner side of a sheet, the heating roller heats up the sheet. The fixing belt contacts the side of the sheet opposite the toner side of the sheet. The pressure roller exerts a force on the heating roller by pressing against the fixing belt. The pad is of a softer material than the fixing belt, and in addition to pressing the fixing belt against the heating roller via the fixing belt, the pad is inclined from the pressure roller. The spring biases the pad toward the pressure roller and the heating roller.

The embodiment will be described in conjunction with FIGS. 1 to 4.

Figure 1:
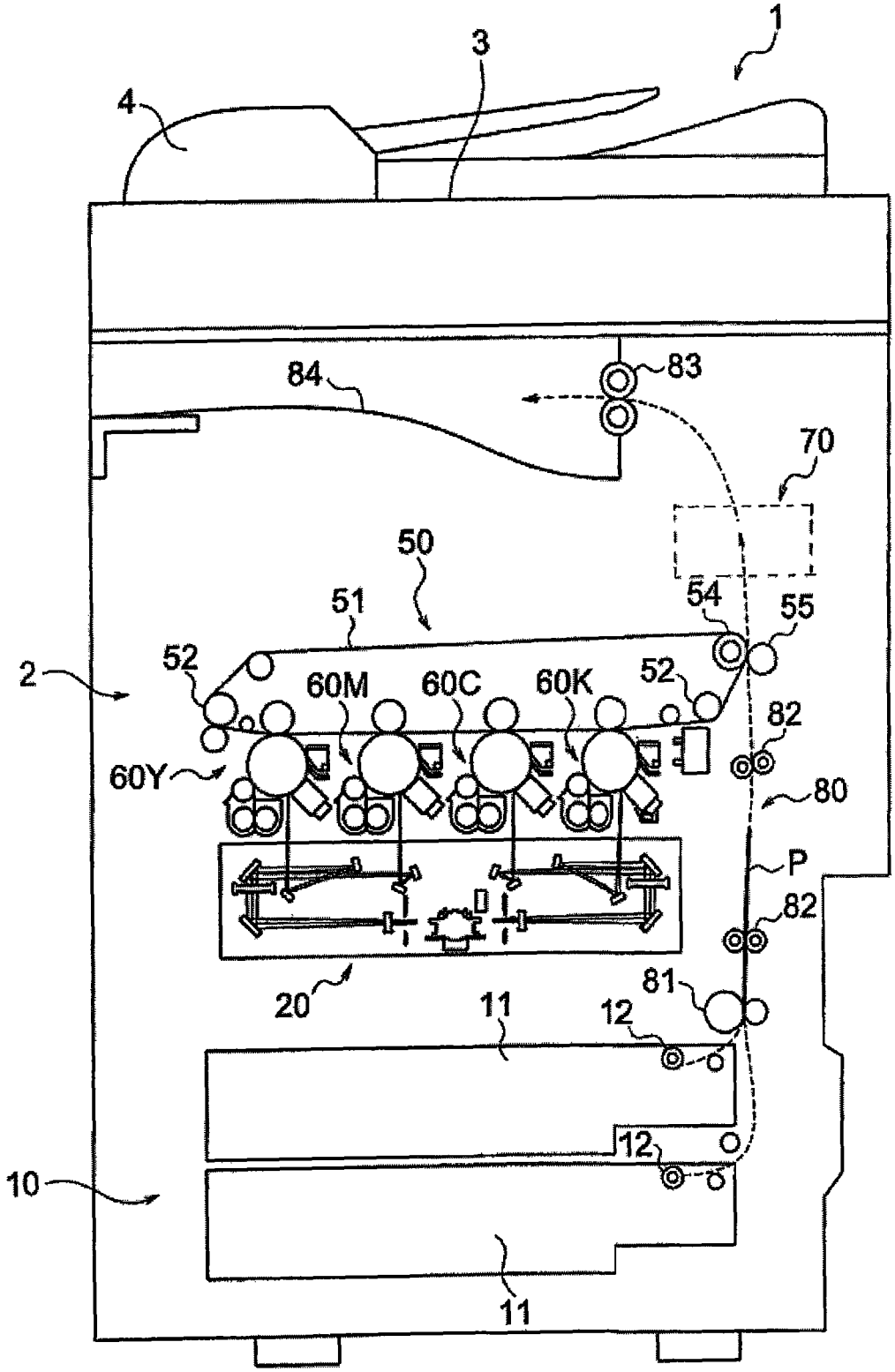
FIG. 1 is a longitudinal sectional view of an image-forming apparatus according to an embodiment.

FIG. 1 is a longitudinal sectional view showing Multi-Functional Peripheral (MFP) 1, which is a color-image-forming apparatus. MFP 1 is equipped with a printer unit 2, a scanner unit 3, and a manuscript conveyor unit.

The printer unit 2 is equipped with a paper-feeding unit 10, a laser optics unit 20, an image-forming unit 50, a fixing apparatus 70, and a conveyor unit 80.

The paper-feeding unit 10 includes multiple paper-feeding cassettes 11, which each house stacked sheets, and a pickup roller 12, which feeds sheets of recording medium from the top of those housed in cassette 11 to the image-forming unit 50.

The image-forming unit 50 is equipped with a central transcription belt 51, which transcribes the toner image formed by four pairs of image-forming stations 60Y, 60M, 60C, and 60K of Y (yellow), M (magenta), C (cyan) and K (black) and a drive roller 54 for driving the central transcription belt 51 and multiple rollers 52 to provide prescribed elasticity to the central transcription belt 51. In addition, the image-forming unit 50 is equipped with a transcription roller 55, which is a transcription vessel. The central transcription belt 51 is fed between the drive roller 54 and the transcription roller 55.

The conveyor unit 80 includes a resist roller 81, which initiates conveyance of sheet reeled out from the pickup roller 12 to the image-forming unit 50 at prescribed timing, and multiple conveyor rollers 82, which transports sheet P reeled out from the resist roller. In addition, the conveyor unit 80 has a paper discharger roller 83 disposed on the upper surface of the printer unit 2 and proximate the point at which sheet P is discharged to the outside of the printer unit 2 and into a catch tray 84, which receives sheet P ejected from a discharger roller 83.

Figure 2:
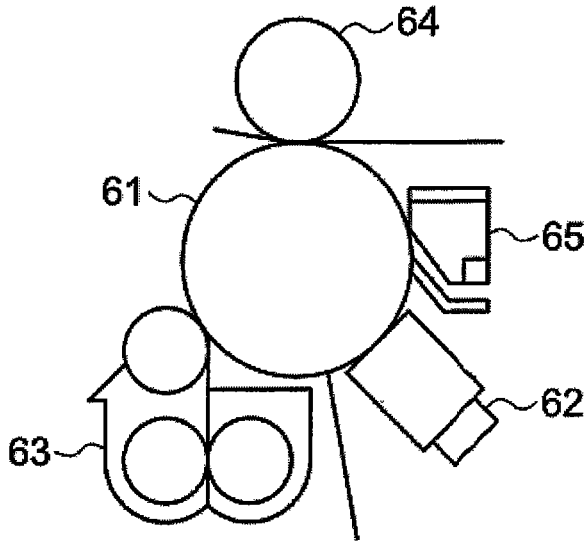
FIG. 2 is a close-up view of the area surrounding the photoreceptor in FIG. 1.

The following is an explanation that corresponds with the closeup view of one of the image-forming stations 60 (i.e., image-forming stations 60Y, 60M, 60C, and 60K in FIG. 2.

An image-forming station 60 is equipped with a photoreceptor 61, which is irradiated with light emitted from the laser optics unit 20 (shown in FIG. 1), a charging vessel 62, which gives a uniform electronic charge to the photoreceptor 61, a development vessel 63, which stores toner internally and provides toner to the photoreceptor 61, a central transcription roller 64, which transcribes provided toner in the photoreceptor 61 to the central transcription belt 51, a cleaning unit 65, which cleans the toner remaining on the photoreceptor 61 without being transcribed onto the central transcription belt 51, and the like. Each of the image-forming stations 60Y, 60M, 60C, and 60K are of the same configuration.

The following is an explanation of an image-forming operation that maybe used in conjunction with embodiments of the invention.

The charging vessel 62 provides a unified electrical charge to the photoreceptor 61. The photoreceptor 60, which has been provided with the unified charge, has a latent image formed through light emitted from the laser optics unit 20. The development vessel 63 provides toner to the photoreceptor 61 and forms a toner image on the photoreceptor 61. The toner image formed on the photoreceptor 61 through the development vessel 63 is transcribed via the central transcription roller 64 onto the central transcription belt 51.

In addition, the sheet P reeled out through the pickup roller 12 from the paper feed cassette 11 is sent out by the plural conveyor rollers 82. The toner image formed on the central transcription belt 51 is transcribed onto sheet P when the sheet comes to the transcription roller 55. The sheet P, onto which the image has been transcribed, is conveyed to a fuser 70, which fixes the transcribes image onto the sheet P, and is ejected onto a catch tray 84.

Figure 3:
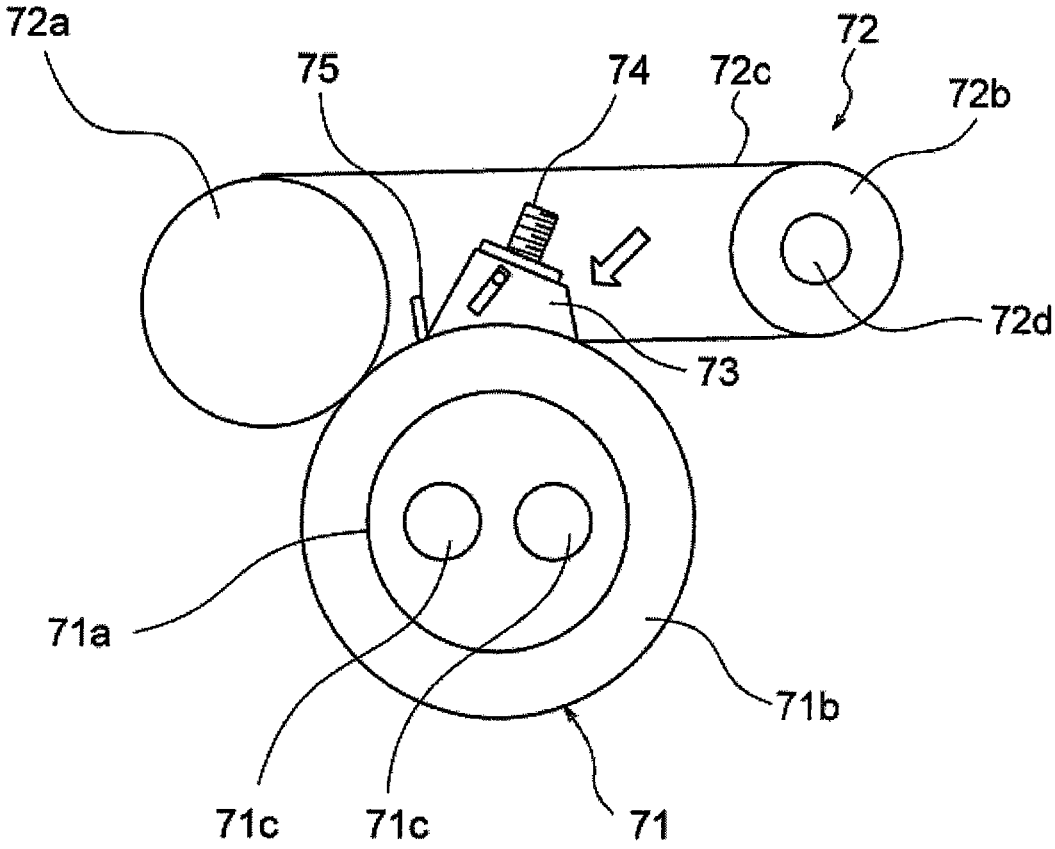
FIG. 3 is a detailed longitudinal sectional view of the fuser FIG. 1.
Figure 4:
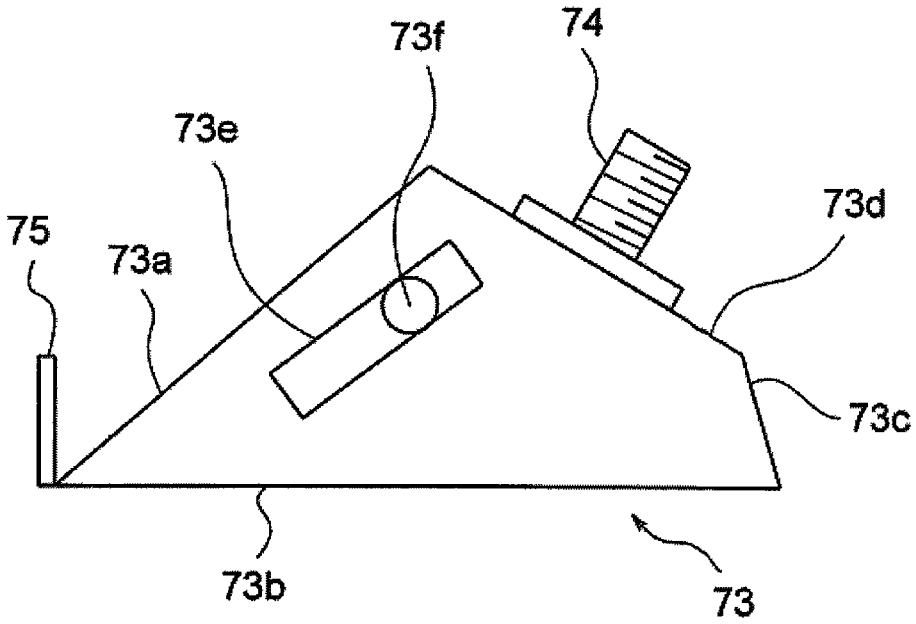
FIG. 4 is a close-up view of the pad in FIG. 3.

The following explains the fuser 70 in detail using FIGS. 3 and 4. FIG. 3 is a rotated view of fuser 70 in FIG. 1 that is rotated at a 90-degree angle counterclockwise compared to the view of fuser 70 in FIG. 1. As such, the left side of the page is FIG. 3 is the sheet conveyance direction through fuser 70. In contrast, in FIG. 1 the top of the page is the sheet conveyance direction through fuser 70.

The fuser 70 is equipped with a heating roller 71, a pressure element 72, a pad 73, a spring 74, a stopper 75, and the like. The heating roller 71 is equipped with a hollow cylinder pipe 71*a*, which is made of aluminum, a rubber roller 71*b*, which is formed of heat-resistant elastic material placed on the circumference of the hollow cylinder pipe 71*a*, and two heating lamps 71*c* that are set parallel in an axial direction of the hollow cylinder pipe 71*a* inside hollow cylinder pipe 71*a*. The heating roller 71 receives power from the drive source (not shown) and rotates counterclockwise in FIG. 3. The material of the hollow cylinder pipe may be iron. In addition, there may be one heating lamp, three, or more. Moreover, it is possible to place a heater within the hollow cylinder pipe 71*a* parallel to the axis of the hollow cylinder pipe 71*a* instead of the lamp. Furthermore, it is also possible to place an induction heating coil as the heating element against the circumference surface of the hollow cylinder pipe 71*a*. At this time, the heating roller is defined as including the induction heating coil.

The pressure element 72 is equipped with a first pressure roller 72*a*, a second pressure roller 72*b*, and a fixing belt 72*c*. The fixing belt 72*c* is a continuous belt and has the first pressure roller 72*a* and the second pressure roller 72*b* situated within it. The first pressure roller 72*a* and the second pressure roller 72*b* are placed on each side of the heating roller 71 and give elasticity to the fixing belt 72*c*. That is to say, the outer peripheral surfaces of the first pressure roller 72*a* and the second pressure roller 72*b* are in contact with the inner peripheral surface of the fixing belt 72*c*. The first pressure roller 72*a* forms a nip via the fixing belt 72*c*. Namely, the nip is formed by the outer peripheral surface of the heating roller 71 and the outer peripheral surface region of the fixing belt 72*c*, where the latter corresponds to the region of the fixing belt 72*c* that contacts both the outer periphery of the first pressure roller 72*a* and the outer peripheral surface of the heating roller 71. The first pressure roller 72*a* may have a structure of a silicon rubber elastic body wrapped around a core metal. The elastic body may be a sponge and is not limited to silicon rubber. The first pressure roller 72*a* presses against the heating roller 71 via the fixing belt 72*c*.

The second pressure roller 72*b* is equipped with a heat lamp 72*d* internally and provides a prescribed heat quantity to the fixing belt 72*c*. With respect to the sheet conveyance direction, the second pressure roller 72*b* is placed upstream from the first pressure roller 72*a*, namely on the side of the transcription roller 55 (shown in FIG. 1). The second pressure roller 72 does not form a nip with the heating roller 71 via the fixing belt 72*c*. There is a space between the fixing belt 72*c* and the heating roller 71 to receive conveyed sheets.

The fixing belt 72*c* may be formed from heat-resistant polyimide resin. The fixing belt 72*c* receives a prescribed heat quantity from the heating roller 71. In some embodiments, the fixing belt 72*c* receives a heat quantity from the heating roller 71 larger than that receiving from the second pressure roller 72*b*. The fixing belt 72*c* presses against a prescribed area of the heating roller 71 between the first pressure roller 72*a* and the second pressure roller 72*b*. The rigidity of the fixing belt 72*c* is softer than that of the heating roller 71. As such, the fixing belt 72*c* conforms to the shape of the outer peripheral surface of the heating roller 71 when the fixing belt 72*c* exerts a force against the heating roller 71.

The pad 73 also presses against the inner periphery of the fixing belt 72*c*. The pad 73 is made from a softer material than the fixing belt 72*c*. For example, it is an elastic body made from silicon rubber and sponge. In addition, the pad 73 exerts a force against the heating roller 71 via the fixing belt 72*c*.

A parallel direction to the rotational axis direction of the heating roller 71 is a longitudinal direction and the pad 73 has approximately the same length in this direction, which is orthogonal to the rotational direction of fixing belt 72*c* (i.e., out of the page in FIGS. 3 and 4). Moreover, the cross-sectional surface orthogonal to a longitudinal direction of the pad 73 forms a square four-sided cross-section that has uneven sides of different lengths, with the side located downstream with respect to the sheet conveyance direction being longer than the side located upstream with respect to the sheet conveyance direction. The side located downstream with respect to the sheet conveyance direction is defined as a first side 73*a*. With the first side 73*a* as a starting point, each side (a second side 73*b*, a third side 73*c*, and a fourth side 73*d*) is defined counterclockwise, as shown in FIG. 4. In addition, the second side 73*b* of the pad 73, which is the side that contacts the fixing belt 72*c*, is configured to be longer than each of the other three sides of the pad 73. The second side 73*b* is the portion of pad 73 pressing against the fixing belt 72*c*. A spring 74, which presses against the pad 73, borders the fourth side 73*d*, which is positioned opposite to the second side 73*b*. The first side 73*a* positioned on the side of the pad 73 that faces the first pressure roller 72*a* inclines away from the first pressure roller 72*a*. In some embodiments, a cross-section of the pad 73 when viewed perpendicular to the sheet conveyance direction may be a triangle with the third side omitted. The first side 73*a* does not need to be a straight line and may be a concave figure. In addition, the second side 73*b* may be a concave surface with curvature following the outer periphery surface of the heating roller.

The fourth side 73*d* is not parallel to fixing belt 72*c* and is inclined toward the upstream side (with respect to sheet conveyance direction) of the pad 73 and toward second pressure roller 72*b*. That is, the distance from the fourth side to the fixing belt 72*c* is longer on the downstream side of pad 73 than the upstream side of the pad 73. The spring 74 also exerts a force partially in the direction of sheet conveyance because of this. In this way, the spring 74 biases the pad 73 toward the first pressure roller 72*a* side. The pressing surface is defined as the surface formed by the longitudinal axis of the pad 73 (i.e., out of the page) and the fourth side 73*d*. Numerous identical springs 74 are established on this pressing surface and push the pressing surface with a constant pressure. They may be elements of bias functions such as leaf-springs and are all defined here in this specification sheet as "spring" without being limited to the spring 74.

The pad 73 may be covered with a protective sheet to enhance slippage and also coated against the surface corresponding to the second side. In this case, the pad 73 having a protective sheet or coating is also defined as the pad 73, and even with the protective sheet or coating, the pad 73 is of a softer material than the fixing belt 72*c*.

A rectangular slot 73*e* is established along the first side inside the pad 73. A slot 73*e* has a longitudinal direction edge lined up with the first side 73*a*. A shaft 73*f* is disposed in the rectangular slot 73*e*. The shaft 73*f* has the same longitudinal direction as that of the pad 73 and is longer than the longitudinal direction of the pad 73. The diameter of the shaft 73*f* has about the same traverse direction length as the rectangular slot 73*e* and as such guides the pad 73 movement. The shaft 73*f* is iron and harder than the pad 73. The shaft 73*f* may be of a harder material than the pad 73, such as resin, but is not limited to iron. Protruding parts have been displsed on the outside of pad 73 at both terminals of the shaft 73 so as not to been broken off from the pad 73.

A stopper 75 is located at the intersection of the first side 73*a* and the second side 73*b*. In other words, the stopper 75 is placed between the pad 73 and the first pressure roller 72*a* and inside the fixing belt 72*c*. The stopper 75 prevents the pad 73 from moving too much along the sheet conveyance direction toward the first pressure roller 72*a*. Moreover, the stopper 75 is made of harder material than the pad 73. The stopper 75 borders the fixing belt 72*c* lightly. The stopper 75 may be adjacent to or separate from the fixing belt 72*c*. With regard to stopper 75 abrasion, having the stopper 75 somewhat separated from the fixing belt 72*c* is desirable. However, if the stopper 75 is placed too far from the pad 73, the stopper 75 will lose stopper functions for the pad 73. The stopper 75 may be established entirely in the longitudinal direction, or many stoppers 75s may be configured in that direction.

In some embodiments, the position where the pressure roller 72*a* forms the nip between the heating roller and the fixing belt 72*c* is positioned closer to the heating roller and further from a position where the pad 73 is in contact with the fixing belt 72*c*. In other words, the first pressure roller 72*a* has the effect of pushing the fixing belt 72*c* toward the heating roller 71 more than the pad 73 pushes the fixing belt 72*c* toward the heating roller 71.

The spring 74 may push in the direction of the stopper 75 by itself without using the rectangular slot 73*e* and the shaft 73*f*. The spring 74 has the effect of urging the pad toward the stopper 75. If the direction of urging of the spring 74 is substantially aligned with the guiding direction of the shaft 73*f*, the spring 74 may push in the direction of the stopper 75 more efficiently.

The following is an explanation of the pressing behavior of the spring 74 on the pad 73.

The spring 74 pushes the pad 73 from the fourth side 73*d* of the pad 73. The pressing direction is in the sheet conveyance direction, and therefore is always toward the stopper 75. Even if the pad 73 is worn due to abrasion with the fixing belt 72*c*, the pad 73 moves to downstream side along the sheet conveyance direction due to the pressing force. The intersection of the first side 73*a* and the second side 73*b*, as such, is in contact with the stopper 75. Therefore, the distance between the pad 73 and the first pressure roller 72*a* is kept constant.

By biasing the spring 74 toward the stopper 75 through a long period of use, even if the soft material of the pad 73 wears and is removed, there is substantially no variation in the position of the pad 73 on the downstream side of the sheet conveyance direction, and the gap between the pad 73 and the first pressure roller 72*a* remains substantially constant. Contact between the fixing belt 72*c* and the heating roller is maintained by the pad 73, and so the phenomena of sheets fluttering and images being distorted may be prevented.

In addition, if the first side 73*a* has a concave configuration and the pad 73 does not move toward stopper 75 as pad 73 experiences wear, the distance between the pad 73 and the first pressure roller 72*a* grows wider than when the first side 73*a* is a straight line. In the present embodiment that includes movement of pad 75 toward stopper 75 as wear of pad 73 occurs, such an effect is even greater when first side 73*a* has a concave configuration.

Moreover, in this embodiment, since the pad 73 forms the nip between the heating roller 71 and and the fixing belt 72*c*, nip depth may be maintained across a longer portion of the sheet conveyance path than when a rotational roller is used instead of the pad 73. Consequently, heat can be applied for a longer period of time to the sheets to increase the efficiency of the fixing.

In the present embodiment, an explanation has been given that takes into account the case in which sheets in the fuser move from down to up, but without limiting to this case, even in the case in which sheets are transported in the horizontal direction, the same effect may be realized for fuser parts.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A fuser comprising:

a heating roller configured to rotate, contact a toner surface side of a sheet, and heat the sheet;

a fixing belt that contacts with a side of the sheet that is opposite to the toner surface side;

a pressure roller configured to press the fixing belt against the heating roller;

a pad that is made of material that is softer than that of the fixing belt, and is configured to press the fixing belt against the heating roller; and a spring that is configured to urge the pad in a direction toward a point that is between centers of the heating roller and the pressure roller.

2. The fuser according to claim 1, wherein a surface of the pad that contacts the fixing belt comprises a concave surface with a curvature substantially similar to a curvature of the peripheral surface of the heating roller.

3. The fuser according to claim 1, further comprising a stopper element disposed between the pad and the pressure roller that is configured to prevent the pad from moving toward the pressure roller.

4. The fuser according to claim 3, wherein the stopper element is made of material that is harder than that of the pad.

5. The fuser according to claim 3, wherein the stopper element contacts the same side of the fixing belt that contacts the pad.

6. The fuser according to claim 1, wherein the pad has multiple sides and a side of the pad that contacts the fixing belt is the longest side of the pad.

7. The fuser according to claim 1, wherein the side of the pad that faces toward the pressure roller is inclined away from the pressure roller.

8. The fuser according to claim 7, wherein the side of the pad that faces toward the pressure roller is a straight line and the direction in which the spring urges the pad toward the pressure roller is substantially parallel to the straight line.

9. The fuser according to claim 7, wherein the pad is configured with a rectangular slot that is substantially parallel with the straight line and a guide shaft that is disposed in the rectangular slot and configured to guide movement of the pad as material is removed from the pad during use.

10. The fuser according to claim 1, wherein the pressure roller is disposed downstream with respect to the pad in the sheet conveyance direction.

11. An image-forming apparatus comprising:

a photoreceptor configured to form a latent image;

a development vessel configured to provide development agent for the photoreceptor and to form a toner image on the photoreceptor;

a transcription vessel that transcribes the toner image formed on the photoreceptor through the development vessel onto a sheet;

a heating roller configured to rotate, contact a toner surface side of the sheet, and heat the sheet;

a fixing belt that contacts with a side of the sheet that is opposite to the toner surface side;

a pressure roller configured to press the fixing belt against the heating roller;

a pad that is made of material that is softer than that of the fixing belt and is configured to press the fixing belt against the heating roller; and a spring configured to urge the pad in a direction toward a point between centers of the heating roller and the pressure roller.

12. The fuser according to claim 11, wherein a surface of the pad that contacts the fixing belt comprises a concave surface with a curvature substantially similar to a curvature of the peripheral surface of the heating roller.

13. The fuser according to claim 11, further comprising a stopper element disposed between the pad and the pressure roller that is configured to prevent the pad from moving toward the pressure roller.

14. The fuser according to claim 13, wherein the stopper element is made of material that is harder than that of the pad.

15. The fuser according to claim 13, wherein the stopper element contacts the same side of the fixing belt that contacts the pad.

16. The fuser according to claim 11, wherein the pad has multiple sides and a side of the pad that contacts the fixing belt is the longest side of the pad.

17. The fuser according to claim 16, wherein a side of the pad that faces toward the pressure roller is inclined away from the pressure roller.

18. The fuser according to claim 11, wherein the pad is configured with a rectangular slot and a guide shaft that is disposed in the rectangular slot and configured to guide movement of the pad as material is removed from the pad during use.

19. A method of fixing a toner image on a sheet, the method comprising:

conveying a sheet having a toner image into a nip between a heating roller and a fixing belt; and urging a pad against the fixing belt to press the sheet against the heating roller, the direction of the urging being toward a point between a position downstream of the nip in the sheet conveyance direction and a center of the heating roller.

20. The fuser according to claim 19, wherein a surface of the pad that contacts the fixing belt comprises a concave surface with a curvature substantially similar to a curvature of the peripheral surface of the heating roller.

* * * * *